US005575025A

United States Patent [19]

Peters

[11] Patent Number: 5,575,025

[45] Date of Patent: Nov. 19, 1996

[54] GURNEY WITH PROTECTIVE COVER

[76] Inventor: Michael J. Peters, 5040 Sebring Ct., Bloomfield Hills, Mich. 48302

[21] Appl. No.: 337,778

[22] Filed: Nov. 14, 1994

[51] Int. Cl.[6] ..... A47C 31/00; A47G 9/00

[52] U.S. Cl. ..... 5/600; 5/482; 5/663

[58] Field of Search ..... 5/424, 425, 482, 5/484, 487, 502, 663; 135/88.03, 115; 4/498, 501, 503, 513, 499; 52/3, 4

[56] References Cited

U.S. PATENT DOCUMENTS

| | | | |
|---|---|---|---|
| 3,576,039 | 9/1968 | Roberts | 5/484 |
| 3,844,471 | 8/1972 | Hind | 5/425 |
| 4,248,216 | 2/1981 | Glintz | 5/482 |
| 4,664,959 | 5/1987 | Dagenais et al. | 5/484 |
| 5,022,101 | 6/1991 | Gosselin et al. | 4/498 |
| 5,044,025 | 9/1991 | Hunsinger et al. | 5/424 |
| 5,097,550 | 3/1992 | Marra, Jr. | 5/424 |

FOREIGN PATENT DOCUMENTS

| | | | |
|---|---|---|---|
| 0208557 | 1/1987 | European Pat. Off. | 5/482 |

*Primary Examiner*—Steven N. Meyers
*Assistant Examiner*—Robert G. Santos
*Attorney, Agent, or Firm*—Lyon, P.C.

[57] ABSTRACT

A protective cover (22) for disposition over a patient bearing structure, such as a gurney (10) comprises a liquid impervious membrane having a liquid absorbent pad (24) thereon. The cover (22) minimizes transportation of potentially infectious biological fluids to the gurney (10). The cover (22) is further provided with triangular corner flaps (46), (48), (50), and (52), which allow railings (14), (16), (18), and (20) to be raised or lowered without requiring the cover (22) to be unfastened.

1 Claim, 3 Drawing Sheets

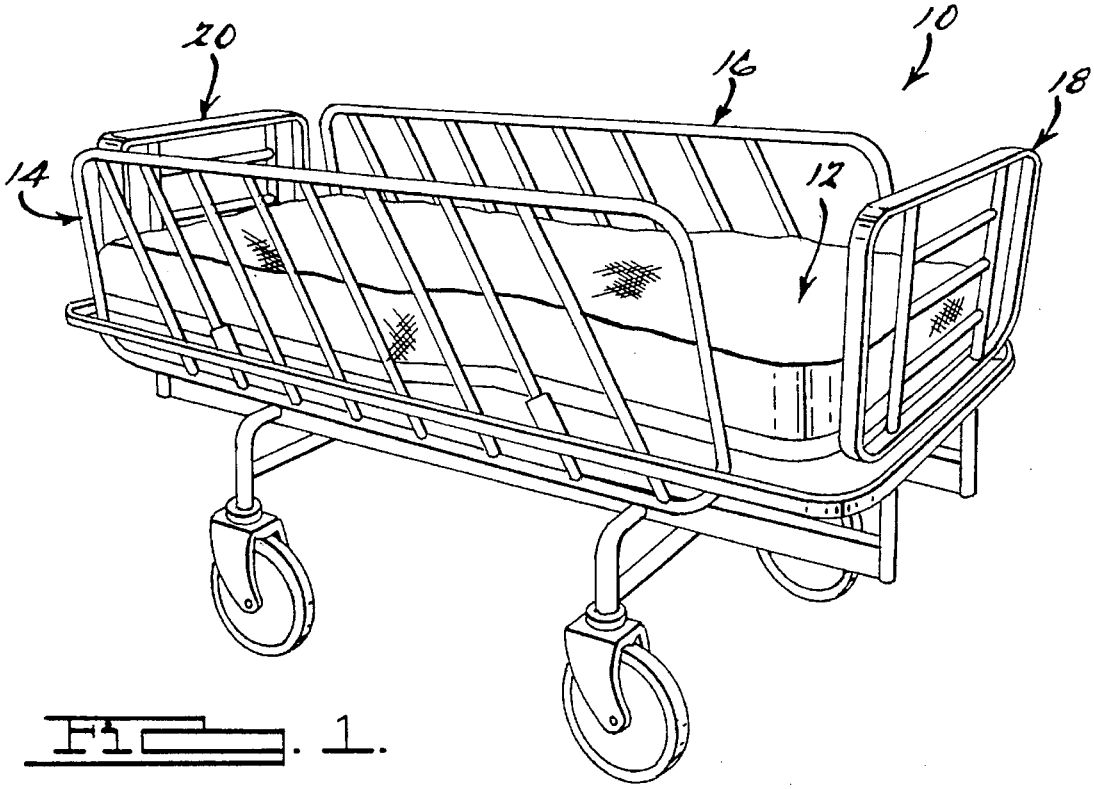
FIG. 1.
FIG. 2.
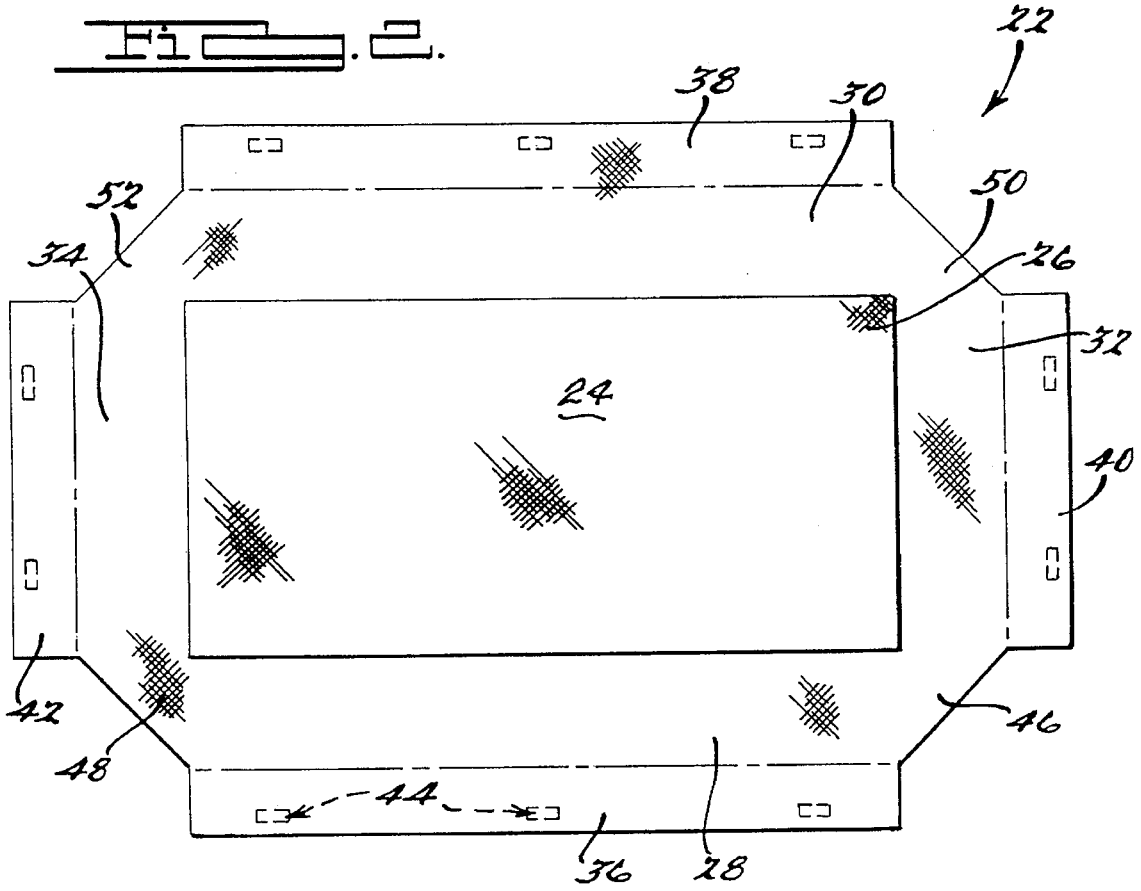

GURNEY WITH PROTECTIVE COVER

BACKGROUND OF THE INVENTION

The present invention relates generally to medical equipment, and more particularly to a novel protective covering that prevents the spread of infection by gurneys and other nonsterile patient bearing structures.

Medical facilities utilize gurneys and other various stationary and mobile patient bearing structures, such as carts, beds, and tables, to examine and/or transport patients within the facility. Infectious biological fluids, for example, blood and mucus, inevitably accumulate on such patient bearing structures, thereby increasing susceptibility to infection for occupants, as well as for medical practitioners and facility personnel.

Emergency room gurneys are particularly vulnerable to contamination. Emergency rooms must accommodate a high volume of patients and, as a practical matter, emergency room gurneys are seldom washed yet are continually occupied by patients who are often bleeding or discharging other potentially infectious biological fluids. Emergency room gurney railings provide an especially high risk for infection because such railings are often chronically contaminated with dried infectious biological fluids, which may then be communicated to the medical facility staff.

Fresh linen is typically placed onto mattresses of patient bearing structures prior to each new patient's occupancy thereof, but washing or cleaning of patient bearing structures is considerably less frequent. Manual cleaning often consumes valuable nursing time and also removes the patient bearing structure from service for an extended period of time. Chemicals and other materials necessary for cleaning generate additional expenses. Further, manual cleaning is not sufficiently reliable because contaminated stains are seldom completely eliminated, and thus the risk of transferring pathogens still exists.

SUMMARY OF THE INVENTION

The aforesaid problems are solved, in accordance with a preferred constructed embodiment of the present invention, by a protective cover for a patient bearing structure. The cover is made of a flexible, fluid impervious material and may be provided with an absorbent pad thereon. The cover is adapted to conform to the shape and configuration of the patent bearing structure.

In further accordance with the present invention, the cover is provided with flaps to accommodate raising or lowering of one or more patent bearing structure railings without creating stress on the cover. The cover is attached to each railing by an attachment means, such as adhesive strips, which allow for selective attachment or detachment of the cover to each railing.

The present invention will be more fully understood upon reading the following detailed description of the preferred embodiment in conjunction with the accompanying drawings.

BRIEF DESCRIPTION OF THE DRAWINGS

FIG. 1 illustrates a gurney prior to attachment of a protective cover thereon;

FIG. 2 illustrates a preferred embodiment of the flat protective cover, in accordance with the present invention, prior to attachment onto the gurney;

DETAILED DESCRIPTION OF THE PREFERRED EMBODIMENT(S)

Figure 3:
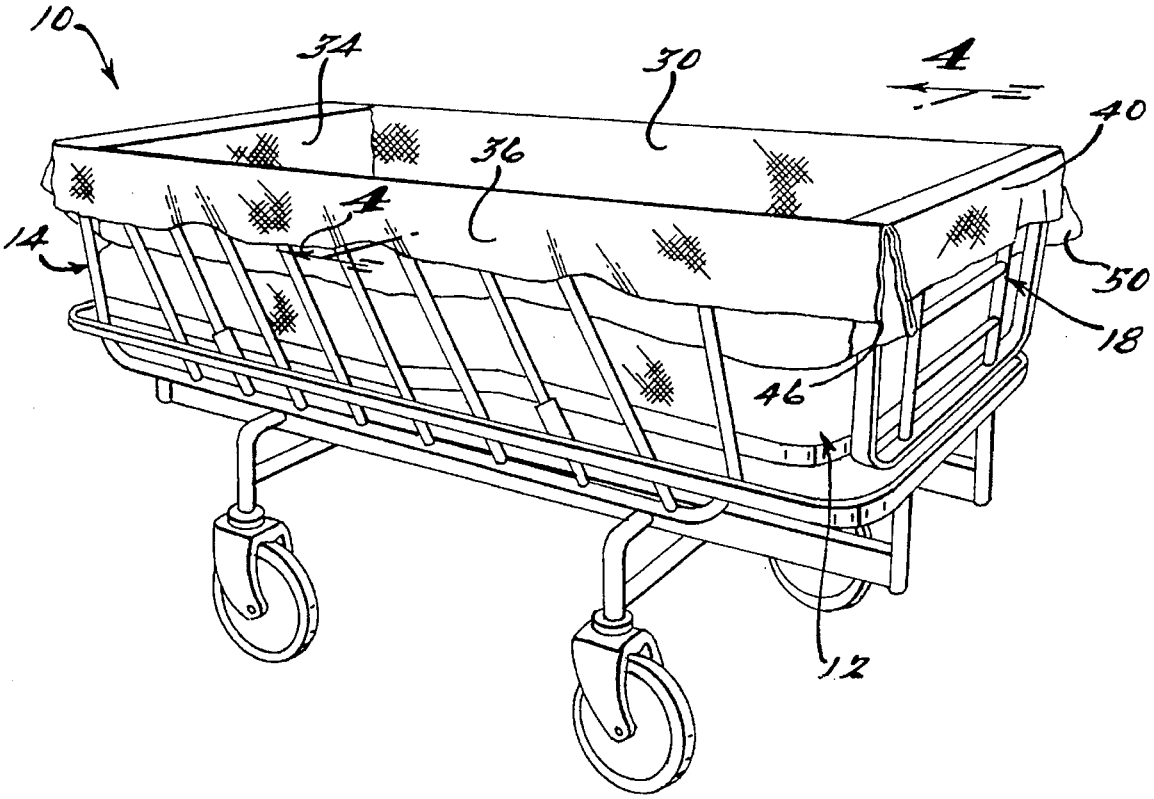
FIG. 3 is a perspective view of the protective cover disposed about the gurney wherein side railings of said gurney are in a raised position.

Referring to FIG. 1 of the drawings, a gurney 10 illustrates one application where the instant invention has particular utility. The gurney 10 is of conventional construction and comprises a mattress 12, a pair of side railings 14 and 16, a head end railing 18, and a foot end railing 20.

Figure 4:
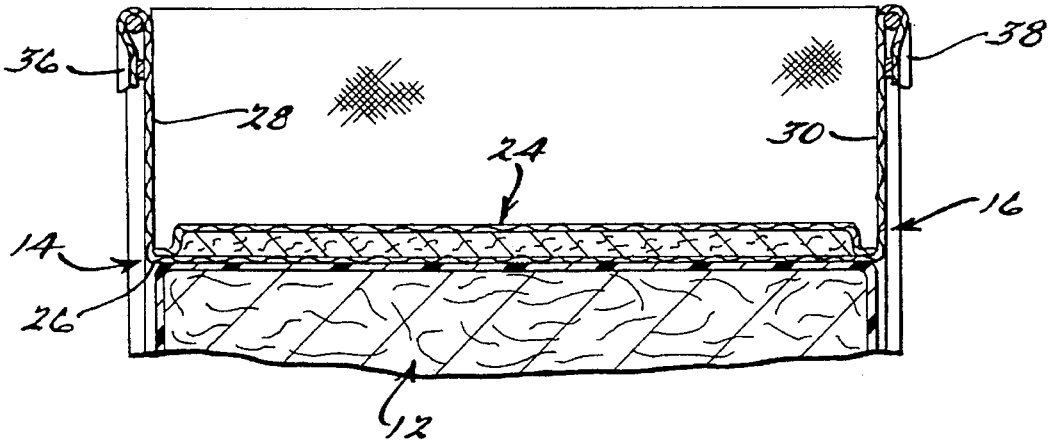
FIG. 4 is a cross-sectional view taken in the direction of the arrow 4 of FIG. 3.

In accordance with the present invention, and as seen in FIGS. 2–5, a protective cover 22 is disposed about the gurney 10 so as to minimize transfer of potentially infectious biological fluids, e.g., blood and mucus, onto the gurney 10. The cover 22 is made of a flexible, fluid impervious material, for example, a thin, transparent polymer membrane. As best seen in FIG. 4, the cover 22 is preferably provided with an absorbent pad 24, which is integrated onto a base portion 26 thereof.

Figure 5:
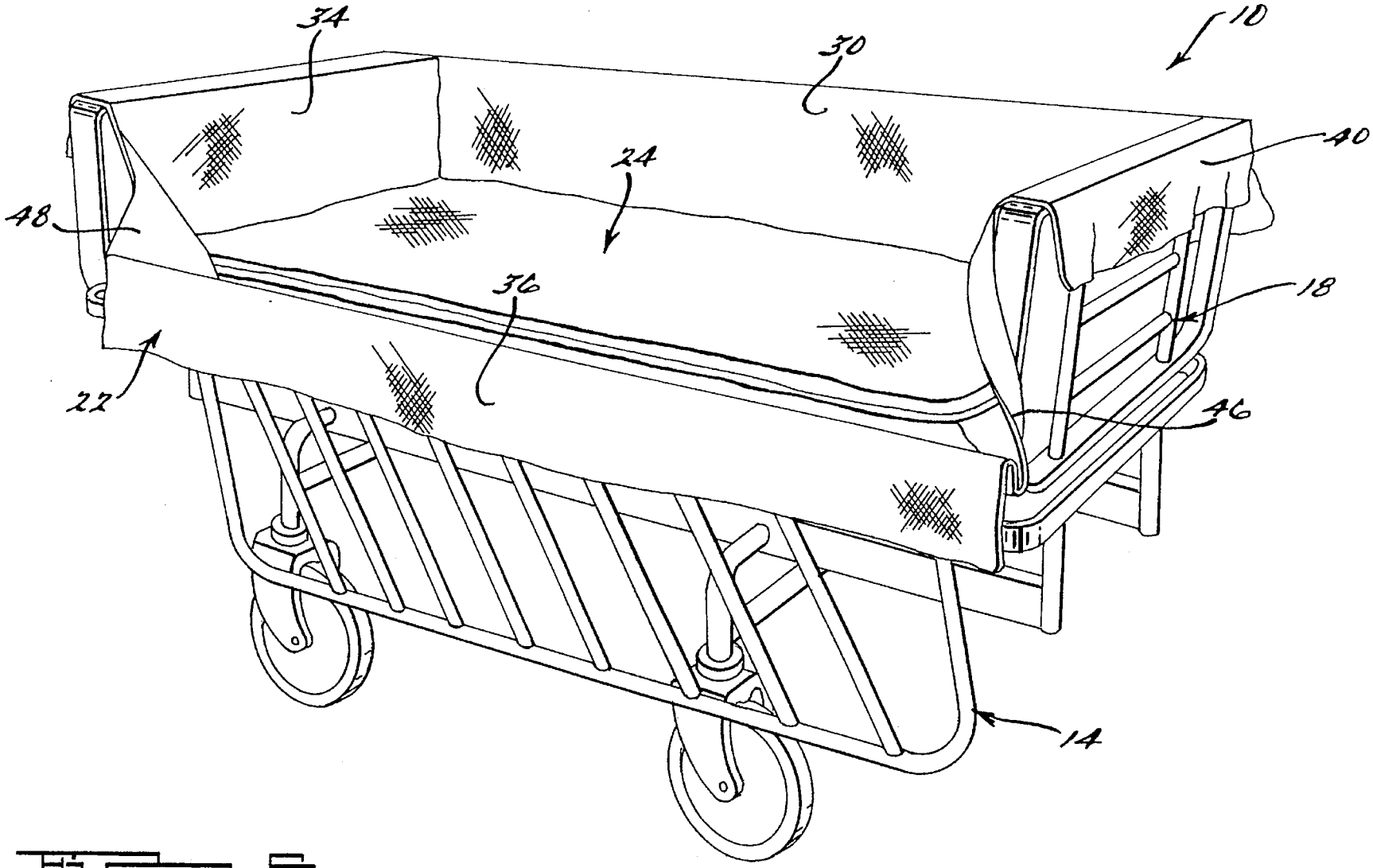
FIG. 5 is a perspective view of the protective cover secured to the gurney wherein one side railing is in a lowered position.

As best seen in FIG. 2, the cover 22 is preferably manufactured as a singular flat sheet and roughly configured but larger than the dimensions of the gurney 10. As seen in FIGS. 3–5, the base portion 26 of the cover 22, with the absorbent pad 24 attached thereon, extends over the surface of the gurney mattress 12. A pair of side portions 28 and 30 of the cover 22 overlie the inner surface of each side railing 14 and 16, respectively. Similarly, a head end portion 32 and a foot end portion 34 of the cover 22 overlie the inner surfaces of the head end railing 18 and the foot end railing 20, respectively.

The side and end portions 28, 30, 32 and 34 of the cover 22 are each folded about an uppermost end of each corresponding railing 14, 16, 18 and 20, respectively, thereby defining an outer attachment end 36, 38, 40, and 42, respectively, on the outer surface of each railing 14, 16, 18, and 20. The outer attachment ends 36, 38, 40 and 42 protect at least a portion of the outside surfaces of the railings 14, 16, 18, and 20 from contamination. Each outer attachment end 36, 38, 40 and 42 of the cover 22 is provided with an attachment means, e.g. a plurality of adhesive strips 44. The adhesive strips are utilized to periodically attach or detach the cover 22 to the outer surface of each railing 14, 16, 18 and 20 of the gurney 10, as desired.

In accordance with another feature of the present invention, the cover 22 is provided with corner flaps 46, 48, 50 and 52, respectively, which serve to contiguously connect each side portion 28 and 30 of the cover 22 with each corresponding adjacent end portion 32 and 34 of cover 22. When the cover 22 is secured to the gurney 10, the flaps 46, 48, 50 and 52 provide excess material in the respective corners of the cover 22, thereby alleviating stress on the cover 22 when one or more gurney railings 14, 16, 18 and 20 are raised or lowered, as seen in FIGS. 4–5. As best seen in FIG. 2, the corner flaps 46, 48, 50 and 52 each preferably have a membrane boundary defined by a substantially straight line extending between the uppermost edge of each side portion, e.g. 28, and the uppermost edge of each corresponding adjacent end portion, e.g. 34.

It is noted that the number of side portions, end portions, and flaps of the cover can be manufactured responsive to the number of corresponding railings present on the gurney. Each side or end portion present on the cover is provided with excess membrane material in the form of a flap. In operation, the flaps accommodate raising or lowering of each railing without tearing the cover or requiring the cover to be unfastened. Further, the advantages and features of the present invention are similarly applicable to other types of patient bearing structures, including but not limited to, carts, tables, beds, and the like.

While the preferred embodiment of the invention has been disclosed, it should be appreciated that the invention is susceptible of modification without departing from the scope of the following claims.

We claim:

1. A gurney comprising:

a planar, horizontally disposed generally rectangular patient supportive surface;

a plurality of vertically extending side and end rails at the sides and ends of the supportive surface respectively and capable of movement from a position below the plane of said supportive surface to a position above the plane of the supportive surface, respectively, and a one-piece fluid impervious membrane comprising:

a generally rectangular base portion complementary to and overlying said patient supportive surface;

a plurality of side and end portions at the sides and ends of the base portion, respectively, covering the inner surfaces of said side and end rails, respectively;

a plurality of attachment portions on the side and end portions of said membrane, respectively, adapted to be folded about an upper edge of said side and end rails, respectively; and a plurality of generally triangular flaps extending between and joining adjacent side and end portions, respectively, of said membrane, each of the flaps extending from the base portion of said membrane the full extent of the side and end portions thereof so as to contain fluids internally of said membrane when said side and end walls are elevated and eliminate tensile stress on the membrane in the event of elevation or lowering of a side or end rail relative to an adjacent side or end rail.

* * * * *